US008747133B2

(12) United States Patent
Shen et al.

(10) Patent No.: US 8,747,133 B2
(45) Date of Patent: Jun. 10, 2014

(54) CARD EDGE CONNECTOR WITH IMPROVED LOCK MECHANISM

(71) Applicant: Hon Hai Precision Industry Co., Ltd., New Taipei (TW)

(72) Inventors: Xue-Hai Shen, Kunshan (CN); Zhuang-Xing Li, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 22 days.

(21) Appl. No.: 13/666,948

(22) Filed: Nov. 1, 2012

(65) Prior Publication Data

US 2013/0109208 A1 May 2, 2013

(30) Foreign Application Priority Data

Nov. 2, 2011 (CN) ..... 2011 2 0427935

(51) Int. Cl.
*H01R 13/62* (2006.01)

(52) U.S. Cl.
USPC ..... 439/160; 439/157

(58) Field of Classification Search
CPC ..... H01R 12/7005; H01R 12/721; H01R 13/6335; H01R 13/62988
USPC ..... 439/157, 159, 160
See application file for complete search history.

(56) References Cited

U.S. PATENT DOCUMENTS 4,241,966 A * 12/1980 Gomez ..... 439/157
5,057,029 A * 10/1991 Noorily ..... 439/160
5,302,133 A * 4/1994 Tondreault ..... 439/157
5,364,282 A * 11/1994 Tondreault ..... 439/157
5,389,000 A * 2/1995 DiViesti et al. ..... 439/157
5,429,523 A * 7/1995 Tondreault ..... 439/157
5,445,531 A * 8/1995 Billman et al. ..... 439/160
5,468,156 A * 11/1995 Flinchbaugh et al. ..... 439/157
5,470,240 A * 11/1995 Suzuki ..... 439/157
5,558,528 A * 9/1996 Cheng et al. ..... 439/160
5,603,625 A * 2/1997 Tondreault ..... 439/157
5,609,493 A * 3/1997 Cheng et al. ..... 439/157
5,634,803 A * 6/1997 Cheng et al. ..... 439/157
5,660,552 A * 8/1997 Suzuki et al. ..... 439/159
5,672,069 A * 9/1997 Cheng et al. ..... 439/160
5,672,072 A * 9/1997 Arai et al. ..... 439/377
5,690,499 A * 11/1997 Howell et al. ..... 439/157
5,746,613 A * 5/1998 Cheng et al. ..... 439/157
5,746,614 A * 5/1998 Cheng et al. ..... 439/157
5,775,925 A * 7/1998 Tondreault ..... 439/157
5,928,015 A * 7/1999 Tondreault ..... 439/157
5,957,708 A * 9/1999 Lin ..... 439/157

(Continued)

*Primary Examiner* — Ross Gushi
(74) *Attorney, Agent, or Firm* — Wei Te Chung; Ming Chieh Chang

(57) ABSTRACT

A card edge connector 100 includes a longitudinal insulating housing 1, a set of terminals 2 set in the insulating housing 1 and a lock mechanism 5 for locking a daughter card 9. The insulating housing 1 has an elongated slot 112 and a pair of towers 12 positioned at two opposite ends thereof. The lock mechanism 5 includes a locking portion 51 locking the daughter card 9 and an operating portion 52 moving the locking mechanism 5. A depression 55 is formed at one end of the lock mechanism 5 close to the locking portion 51. The card edge connector 100 further includes a handle column 6 received in the depression 55 and extending out of the depression 55. Hence, we can operate the lock mechanism 5 easily, and at the same time, the room the card edge connector occupies can be reduced.

20 Claims, 5 Drawing Sheets

(56) References Cited

U.S. PATENT DOCUMENTS 6,030,239 A * 2/2000 Liu ..... 439/160
6,059,585 A * 5/2000 Liao et al. ..... 439/157
6,074,232 A * 6/2000 Choy et al. ..... 439/328
6,113,404 A * 9/2000 Choy ..... 439/160
6,132,228 A * 10/2000 Lang ..... 439/160
6,152,749 A * 11/2000 Tseng et al. ..... 439/160
6,179,636 B1 * 1/2001 Lin ..... 439/160
6,200,149 B1 * 3/2001 Chi-Chung ..... 439/160
6,227,887 B1 * 5/2001 Choy ..... 439/160
6,244,879 B1 * 6/2001 Liu ..... 439/152
6,250,938 B1 * 6/2001 Tung ..... 439/160
6,276,950 B1 * 8/2001 Yodogawa ..... 439/160
6,315,614 B1 * 11/2001 Hassanzadeh et al. ..... 439/633
6,319,027 B1 * 11/2001 Pickles et al. ..... 439/157
6,368,126 B1 * 4/2002 Lee ..... 439/160
6,379,168 B1 * 4/2002 Wang ..... 439/160
6,390,837 B1 * 5/2002 Lee ..... 439/160
6,503,093 B1 * 1/2003 Sakata et al. ..... 439/328
6,599,142 B2 * 7/2003 Bu ..... 439/157
6,695,630 B1 * 2/2004 Ku ..... 439/152
6,932,633 B2 * 8/2005 Tsai ..... 439/160
7,004,773 B1 * 2/2006 Poh et al. ..... 439/160
7,029,297 B1 * 4/2006 Co et al. ..... 439/152
7,083,448 B2 * 8/2006 Tanigawa ..... 439/160
7,207,815 B1 * 4/2007 Ju ..... 439/159
7,252,523 B1 * 8/2007 Pennypacker et al. ..... 439/160
7,341,467 B2 * 3/2008 Guan et al. ..... 439/160
7,458,842 B1 * 12/2008 Gange ..... 439/490
7,462,049 B2 * 12/2008 Chen et al. ..... 439/160
7,484,978 B1 * 2/2009 Gao ..... 439/160
7,494,354 B2 * 2/2009 Mon et al. ..... 439/160
7,500,863 B2 * 3/2009 Ringler et al. ..... 439/327
7,517,239 B1 * 4/2009 Ju ..... 439/159
7,572,141 B2 * 8/2009 Sun ..... 439/485
7,618,270 B2 * 11/2009 Scherer et al. ..... 439/152
7,677,907 B2 * 3/2010 Guan et al. ..... 439/157
7,749,006 B2 * 7/2010 Chiang et al. ..... 439/160
7,789,681 B2 * 9/2010 Guan et al. ..... 439/157
7,828,564 B2 * 11/2010 Guan et al. ..... 439/135
7,922,506 B1 * 4/2011 Harlan et al. ..... 439/160
7,934,936 B2 * 5/2011 Yang ..... 439/157
7,938,657 B2 * 5/2011 Tang et al. ..... 439/160
7,938,658 B1 * 5/2011 Zeng et al. ..... 439/160
7,955,099 B2 * 6/2011 Tan ..... 439/157
8,002,563 B2 * 8/2011 Li et al. ..... 439/160
8,254,123 B2 * 8/2012 Sun ..... 361/695
8,277,235 B2 * 10/2012 Lu ..... 439/160
8,371,880 B2 * 2/2013 Ishimaru ..... 439/632
8,393,908 B2 * 3/2013 Li ..... 439/159
8,403,689 B2 * 3/2013 Li et al. ..... 439/160
8,482,932 B2 * 7/2013 Tian et al. ..... 361/784
8,506,312 B2 * 8/2013 Li et al. ..... 439/159
8,517,746 B2 * 8/2013 Manickam ..... 439/160
8,535,077 B2 * 9/2013 Shen et al. ..... 439/328
8,616,907 B2 * 12/2013 Kim et al. ..... 439/260
2002/0076959 A1 * 6/2002 Lee ..... 439/160
2003/0073332 A1 * 4/2003 Bu ..... 439/159
2005/0196992 A1 * 9/2005 Tanigawa ..... 439/160
2006/0003618 A1 * 1/2006 Leidy ..... 439/160
2006/0035493 A1 * 2/2006 Jiang ..... 439/157
2007/0010121 A1 * 1/2007 Haneishi ..... 439/327
2007/0026722 A1 * 2/2007 Ringler et al. ..... 439/381
2007/0032117 A1 * 2/2007 Huang et al. ..... 439/327
2007/0053170 A1 * 3/2007 Yu ..... 361/737
2007/0066105 A1 * 3/2007 Kato et al. ..... 439/159
2007/0161275 A1 * 7/2007 McBroom et al. ..... 439/160
2007/0238323 A1 * 10/2007 Mathews et al. ..... 439/65
2008/0026618 A1 * 1/2008 Mon et al. ..... 439/159
2008/0050955 A1 * 2/2008 Chen et al. ..... 439/159
2008/0050959 A1 * 2/2008 Zhang et al. ..... 439/342
2008/0064240 A1 * 3/2008 Pennypacker et al. ..... 439/157
2008/0176432 A1 * 7/2008 Scherer et al. ..... 439/159
2008/0220634 A1 * 9/2008 Brodsky et al. ..... 439/78
2008/0318448 A1 * 12/2008 Ringler et al. ..... 439/78
2009/0017665 A1 * 1/2009 Gao ..... 439/326
2009/0023308 A1 * 1/2009 Guan et al. ..... 439/62
2009/0093146 A1 * 4/2009 Ju ..... 439/159
2009/0104793 A1 * 4/2009 Chung et al. ..... 439/59
2009/0124110 A1 * 5/2009 Wu et al. ..... 439/345
2009/0186501 A1 * 7/2009 Kao ..... 439/153
2009/0186502 A1 * 7/2009 Chen et al. ..... 439/157
2010/0022114 A1 * 1/2010 Chiu ..... 439/328
2010/0055931 A1 * 3/2010 Chung et al. ..... 439/59
2010/0062647 A1 * 3/2010 Yang ..... 439/630
2010/0062648 A1 * 3/2010 Guan et al. ..... 439/630
2010/0167558 A1 * 7/2010 Guan et al. ..... 439/65
2010/0279531 A1 * 11/2010 Li ..... 439/159
2010/0323544 A1 * 12/2010 Kudo ..... 439/159
2011/0045681 A1 * 2/2011 Tsai ..... 439/328
2011/0053424 A1 * 3/2011 Chen ..... 439/630
2011/0065297 A1 * 3/2011 Guan et al. ..... 439/155
2011/0076868 A1 * 3/2011 Yao et al. ..... 439/153
2011/0081797 A1 * 4/2011 Chang ..... 439/327
2011/0097913 A1 * 4/2011 Fu et al. ..... 439/153
2011/0104913 A1 * 5/2011 Hinkle ..... 439/68
2011/0104952 A1 * 5/2011 Teh ..... 439/633
2011/0117768 A1 * 5/2011 Li et al. ..... 439/345
2011/0124214 A1 * 5/2011 McKee et al. ..... 439/159
2011/0143563 A1 * 6/2011 Li et al. ..... 439/157
2011/0159718 A1 * 6/2011 McKee ..... 439/326
2011/0201234 A1 * 8/2011 Long ..... 439/630
2011/0237101 A1 * 9/2011 Yang ..... 439/153
2011/0281467 A1 * 11/2011 Lee et al. ..... 439/660
2012/0108092 A1 * 5/2012 Li et al. ..... 439/159
2012/0149223 A1 * 6/2012 Feldman et al. ..... 439/157
2012/0164859 A1 * 6/2012 Li et al. ..... 439/153
2012/0178274 A1 * 7/2012 Manickam ..... 439/157
2012/0322283 A1 * 12/2012 Yang ..... 439/157
2012/0329301 A1 * 12/2012 Li et al. ..... 439/157
2013/0040476 A1 * 2/2013 Li et al. ..... 439/147
2013/0059455 A1 * 3/2013 Li et al. ..... 439/157
2013/0084723 A1 * 4/2013 Shen et al. ..... 439/159
2013/0095679 A1 * 4/2013 Li et al. ..... 439/157
2013/0109208 A1 * 5/2013 Shen et al. ..... 439/159
2013/0109216 A1 * 5/2013 Chien ..... 439/345
2013/0130526 A1 * 5/2013 Mo et al. ..... 439/157
2013/0288502 A1 * 10/2013 Bridges et al. ..... 439/325
2013/0288504 A1 * 10/2013 Sass et al. ..... 439/328

* cited by examiner

CARD EDGE CONNECTOR WITH IMPROVED LOCK MECHANISM

BACKGROUND OF THE INVENTION

1. Field of the Invention

The present invention generally relates to a card edge connector and more particularly to a card edge connector with a lock mechanism.

2. Description of Related Art

U.S. Pat. No. 7,789,681, issued on Sep. 7, 2010, discloses a related card edge connector which includes an elongated insulative housing, a plurality of terminals retained in the housing and a pair of lock mechanisms pivoted on two opposited ends of the housing. The lock mechanism is pivot in a plane perpendicular to a longitudinal direction of the insulative housing, thus can shorten the longitudinal size of the insulative housing and can adapt to a miniaturization trends of a printed circuit board. However, said card edge connector is a slanted type card edge connector and have not enough space to operate the lock mechanism.

Hence, an improved card edge connector is desired to overcome the above problems.

SUMMARY OF THE INVENTION

Accordingly, an object of the present invention is to provide a card edge connector can easy to operate the lock mechanism.

To achieve the above object, a card edge connector comprises an elongated insulative housing and a plurality of terminals retained in the housing. The elongated insulative housing defining an elongated slot for insertion of a daughter card and a pair of towers positioned at two opposite ends thereof The terminals protruded into the elongated slot for mating with the daughter card. At least one lock mechanism pivoted on the housing, the lock mechanism defining a locking portion locking with the daughter card, an operating portion moving the lock mechanism, an ejecting portion ejecting the daughter card out of the elongated slot, and a body portion connecting with said portions, a depression being formed at one end of the lock mechanism close to the locking portion. The card edge connector further comprises a handle column received in the depression and extending out of the depression.

Other objects, advantages and novel features of the invention will become more apparent from the following detailed description when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
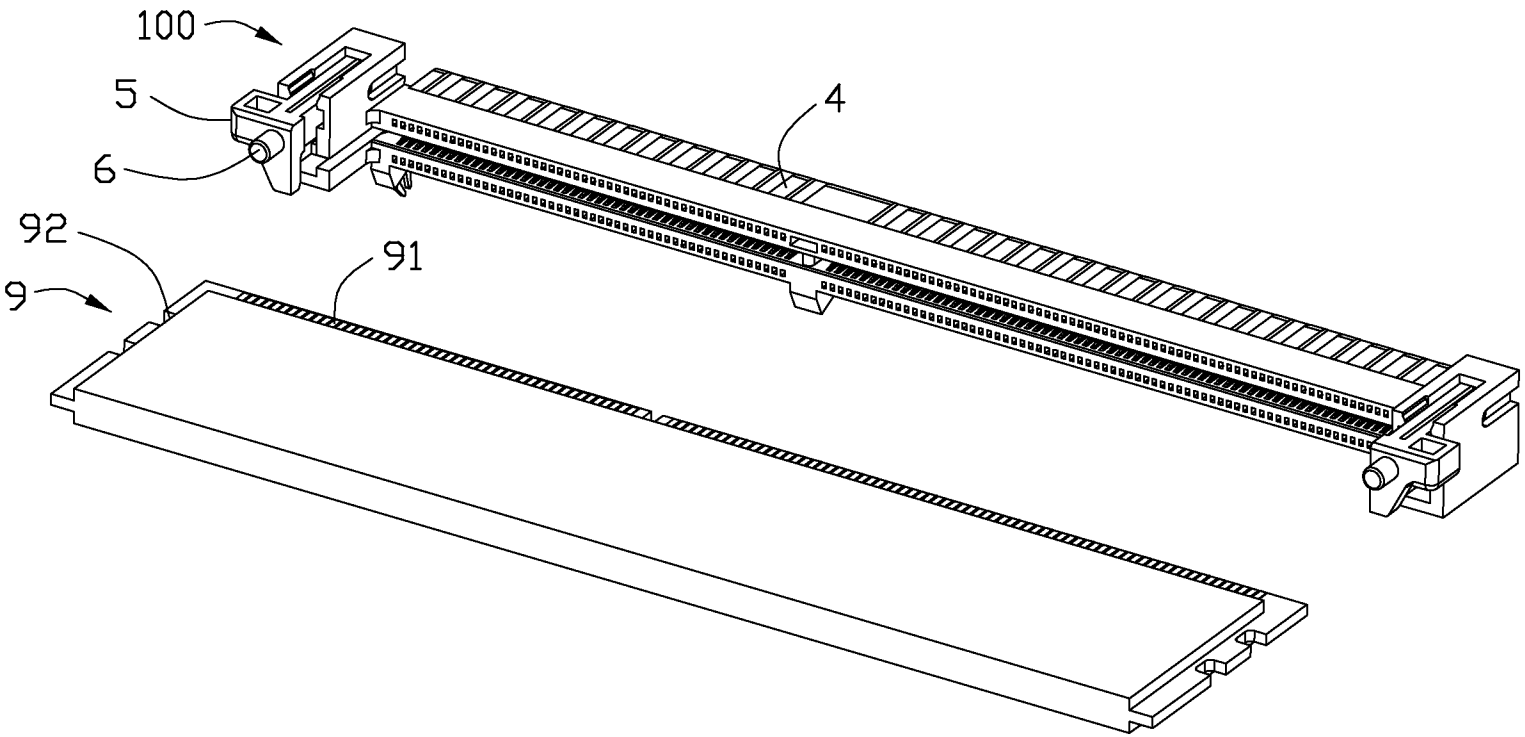
FIG. 1 is an assembled, perspective view of a card edge connector and a daughter card pulled out of the card edge connector.

Reference will be made to the drawing figures to describe the present invention in detail, wherein depicted elements are not easily shown to scale and wherein like or similar elements are designated by same or similar reference numeral through the several views and same or similar terminology.

Figure 2:
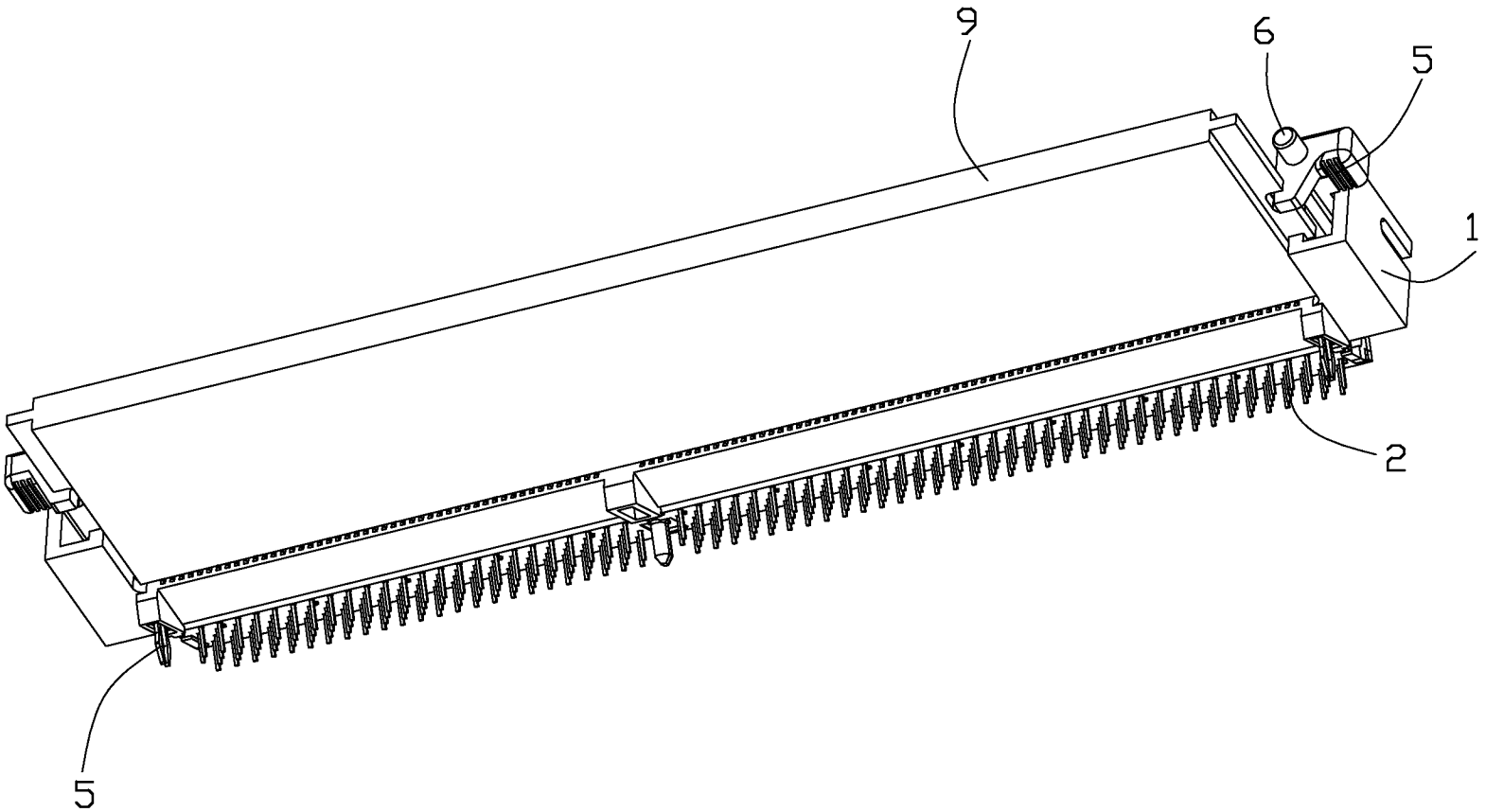
FIG. 2 is an assembled, perspective view of a card edge connector and a daughter card inserted into the card edge connector.
Figure 3:
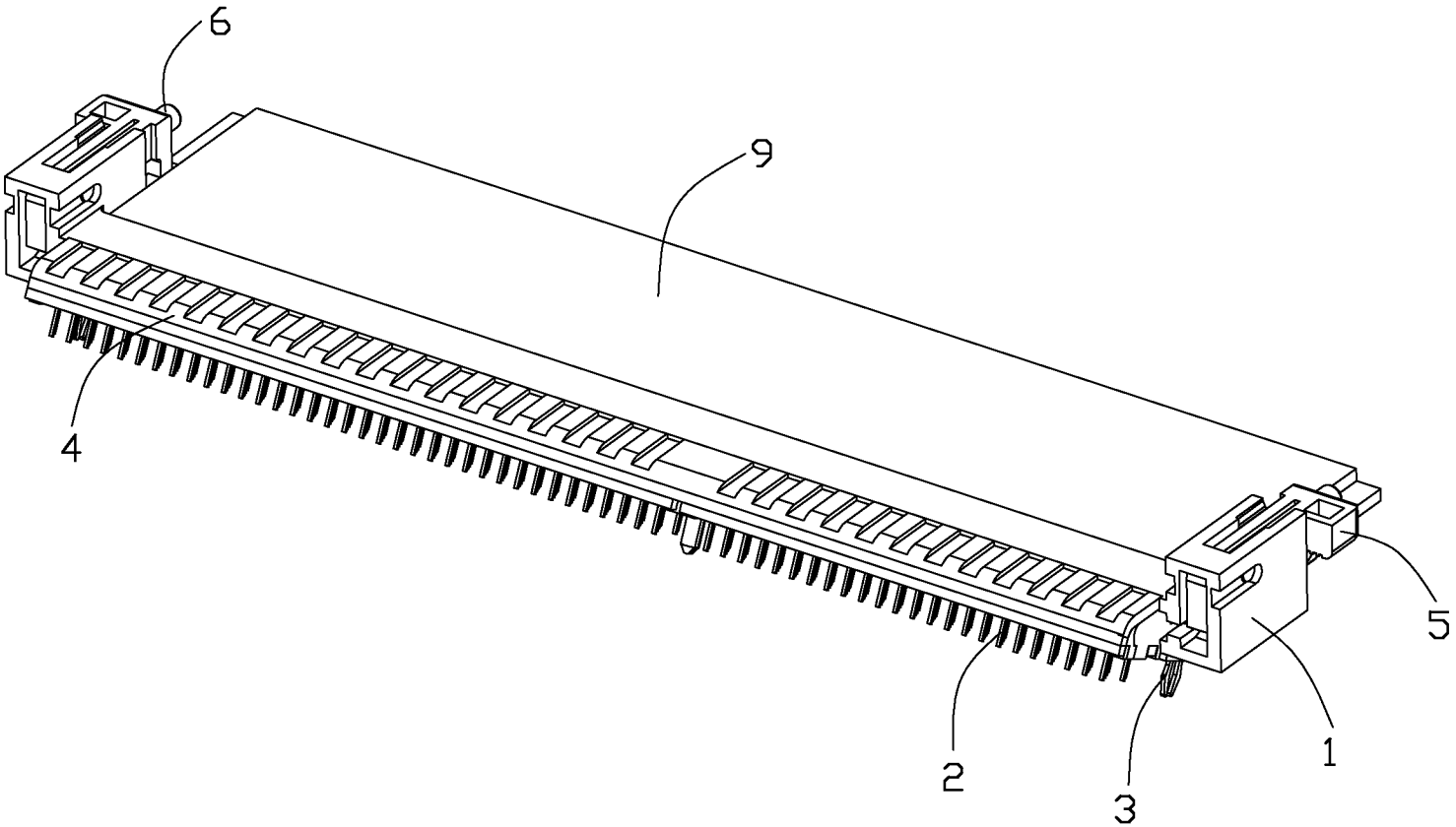
FIG. 3 is another perspective view of the card edge connector shown in FIG. 2.

Referring to FIGS. 1 to 3, a slanted type card edge connector 100 in a preferred embodiment according to the present invention is disclosed and adapted for accommodating a daughter card 9. Said card edge connector 100 comprises an elongated insulative housing 1, a plurality of terminals 2 retained in the housing 1, a pair of board lockers 3 retained in the housing 1 for being mounted on a printed circuit board (not shown), two lock mechanisms 5 pivoted on opposite sides of the housing 1 in a longitudinal direction, a correcting component 4 for retaining and positioning the terminals 3 and a handle column 6 assembled to the lock mechanism 5.

Referring to FIG. 1, a plurality of gold-fingers 91 locate on a end of the daughter card 9 and a pair of notches 92 are formed on two sides of the daughter card 9.

Figure 4:
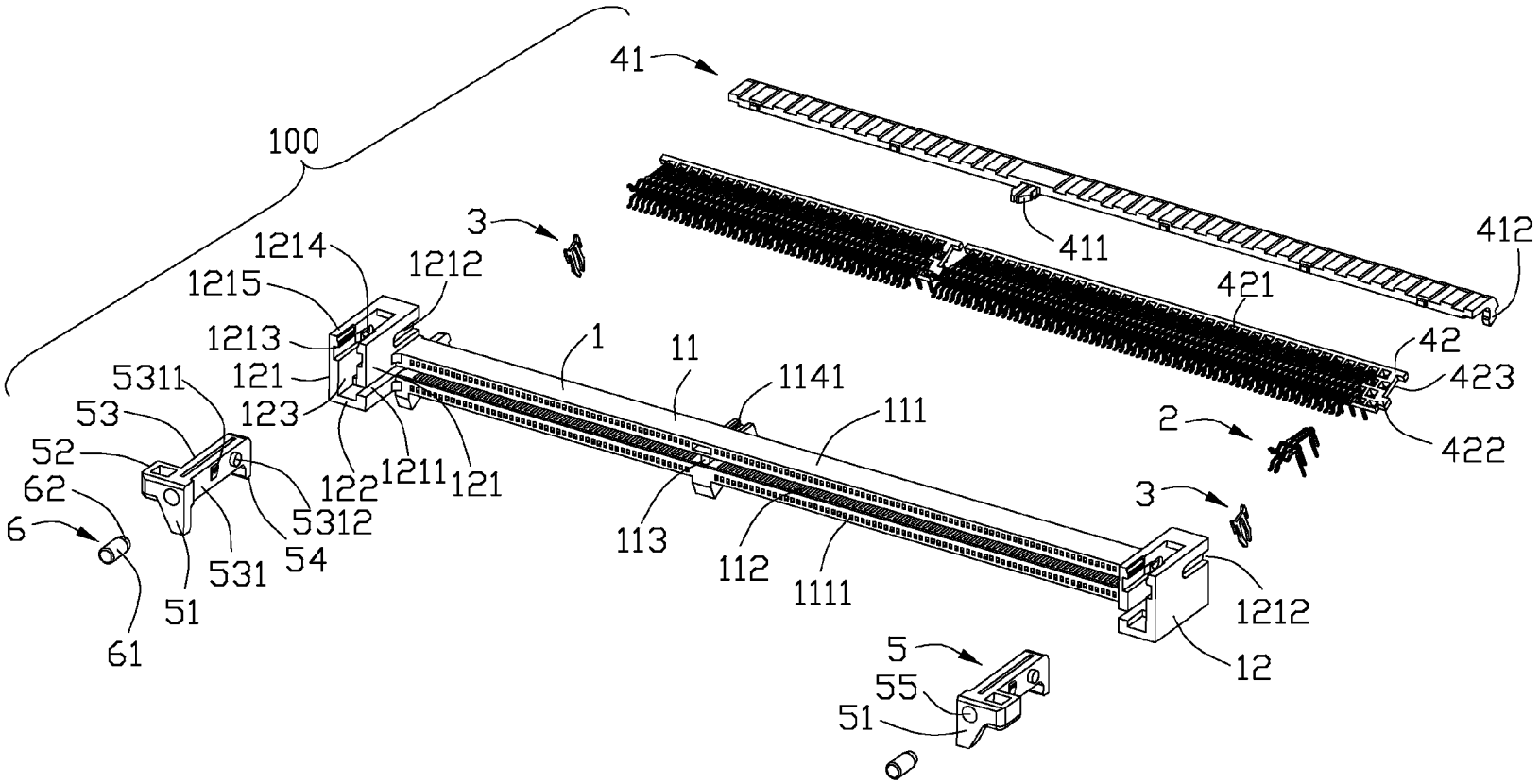
FIG. 4 is an explored, perspective view of the card edge connector according to a preferred embodiment of the present invention.
Figure 5:
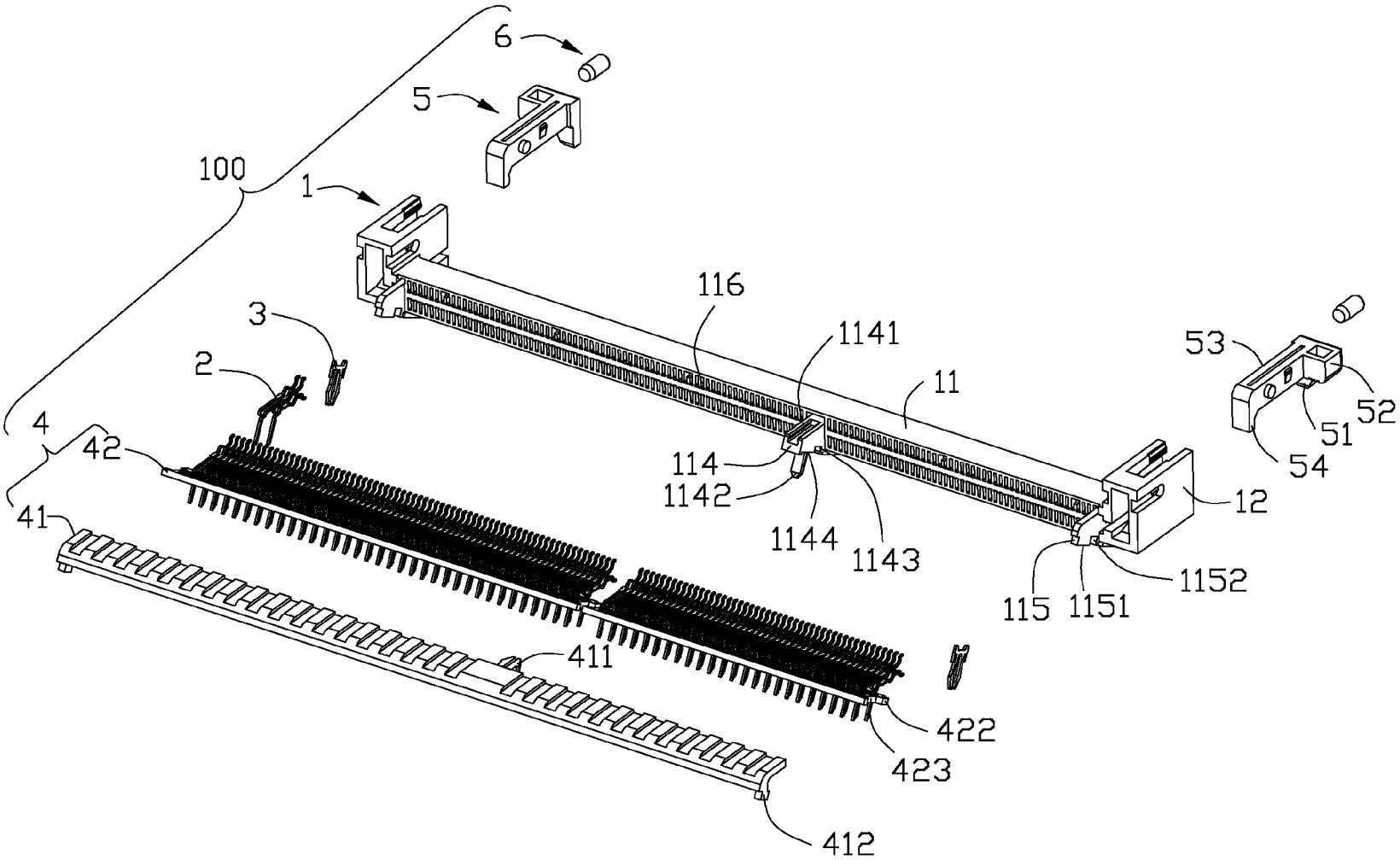
FIG. 5 is another exploded perspective view of the card edge connector shown in FIG. 4.

Referring to FIG. 4 and FIG. 5, said insulative housing 1 defines a base section 11 and two towers 12 located on opposite sides of the base section respectively, the base section 11 defines two outer walls 111 extending in the longitudinal direction and an elongated slot 112 located between the two outer walls 111. The outer wall 111 defines a plurality of passageways 1111 communicating with the elongated slot 112 to receive the terminals 2. A key 13 is formed in the elongated slot 112 to divide the elongated slot 112 into two different parts with different lengths so as to prevent the daughter card 9 from mismating. The insulative housing 1 further has a first tuber 114 located on a rear side 116 of the insulative housing 1 and a pair of second tubers 115 protruding rearwardly from two opposite sides of the insulative housing 1, each of said first and second tubers has a delta-shaped outline. A lock slot 1141 is located on an upper surface of the first tuber 114 and a positioning column 1142 extended on a lower surface of the first tuber 114, the insulative housing 1 can be stably retained to a retaining hole (not shown) of the printed circuit board through the board lockers 3 and the positioning column 1142. Said first tuber 114 defines a first bottom 1144 and a first retaining opening 1143 formed on the first bottom 1144, said second tuber 115 defines a second bottom 1151 and a second retaining opening 1152 formed on the second bottom 1151.

The tower 12 defines two mutually parallel sidewalls 121 and a connecting wall 122 connecting with the two sidewalls 121, said towers 12 defines a receiving slot 123 surrounded by the two sidewalls 121 and the connecting wall 122. Each of the sidewalls 121 defines a hollow 1212 depressed from an outer surface to the receiving slot 123 and each of the hollow 1212 has a semicircular shape structure on an upper end, each of the sidewalls 121 defines a guide groove 1213 depressed from an inner surface to the outer surface and running through a lower end of the guide groove 1213 to formed a pivoting hole 1214 for pivotably receiving the lock mechanism 5. The upper end of the hollow 1212 and the lower end of the guide groove 1213 have a common center of circle, thus can reduce the degree complexity of a mold (not shown). Two obstructs 1215 are located on outsides of the guide grooves 1213 respectively and one of the sidewall 12 has a clipping slot 1211 communicates with the elongated slot 112 for clipping the daughter card 9.

Referring to FIGS. 4 to 5, the lock mechanism 5 is pivot in a plane perpendicular to a longitudinal direction of the insulative housing 1. Said lock mechanism 5 includes a locking portion 51 locking into the notch 92 of the daughter card 9, an operating portion 52 extending along the longitudinal direction of the insulative housing 1, a body portion 53 received in the receiving slot 123 and a ejecting portion 54 for ejecting the daughter card 9 out of the elongated slot 112. Said operating portion 52 projects outwardly from the tower 12 along the longitudinal direction of the insulative housing 1, the thickness of the locking portion 51 is less than the thickness of the operating portion 52 in the longitudinal direction of the lock mechanism 5. An obtuse angle is formed between the operating portion 52 and the locking portion 51 so that can reduce the space of the lock mechanism 5 occupied. The locking portion 51 extends in a transverse direction perpendicular to the longitudinal direction and said handle column 6 is perpendicular to the operating portion 52. The body portion 53 defines two side surfaces 531 coordinating with the two sidewalls 121 respectively, two protrusions 5311 and two pivots 5312 located on the two side surfaces 531 thereof The pivoting hole 1214 have a larger diameter than the pivot 5312 for receiving the pivot 5312, the protrusion 5311 coordinated with the obstruct 1215 so that can prevent the lock mechanism 5 easily open from the receiving slot 123. A depression 55 is formed at one end of the lock mechanism 5 close to the locking portion 51. The locking portion 51, the operating portion 52 and the body portion 53 have front surfaces in a same plane in a longitudinal direction of the lock mechanism 5.

Said handle column 6 has a circular shape and defines a retaining section 62 and a handle 61 formed in a front end of the retaining section 62, the retaining section 62 is received in the depression 55. We can insert the handle column 6 into the depression 55 when the space is not enough to set a finger and then we can push the handle column 6 to move the lock mechanism 5. We also can take the handle column 6 out of the depression 55 when there have enough space to set a finger and then the space the card edge connector 100 occupies can be reduced.

Said correcting component 4 includes a cover 41 has a longitudinal body for covering the terminals and a spacer 42 coordinated with the cover 41. A locking section 411 extending forwardly from the cover 41 and a pair of retaining feet 412 extending downwardly from two opposite sides of the cover 41. Said locking section 411 is locked to the lock slot 1141 of the insulative housing 1 so as to make sure the cove 41 and the insulative housing 1 have a stable connection.

Said spacer 42 includes two sections matched on the insulative housing 1 on both sides of the key 13 respectively. The spacer 42 has a longitudinal body and defines a plurality of through holes 51 for receiving the terminals 2. The spacer 42 defines two openings 423 on the opposite sides thereof for being retained with the first bottom 1144, the second bottom 1151 and the retaining feet 412, and also defines second tubers 422 retained with the first retaining opening 1143 and the second retaining opening 1152 for making the spacer 42 and the insulative housing 1 retain together.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated insulative housing having an elongated slot for insertion of a daughter card and a pair of towers positioned at two opposite ends thereof;

a plurality of terminals retained in the housing and protruding into the elongated slot for mating with the daughter card; and at least one lock mechanism pivoted on the housing, the lock mechanism defining a locking portion locking with the daughter card, an operating portion moving the lock mechanism, an ejecting portion ejecting the daughter card out of the elongated slot, and a body portion connecting with said portions, a depression being formed at one end of the lock mechanism close to the locking portion; wherein the card edge connector further comprises a handle column received in the depression and extending out of the depression.

2. The card edge connector as claimed in claim 1, wherein the depression has a circular hole located on the body portion, the handle column has a circular column, and defines a retaining section and a handle set in a front end of the retaining section, said retaining section is received in the depression.

3. The card edge connector as claimed in claim 2, wherein the card edge connector is a slanted type card edge connector, the lock mechanism is pivot in a plane perpendicular to a longitudinal direction of the insulative housing, the depression is formed on a front surface of the body portion.

4. The card edge connector as claimed in claim 1, wherein the operating portion of the lock mechanism outwardly projects from the tower along the longitudinal direction of the insulative housing, the thickness of the locking portion is less than the thickness of the operating portion in a longitudinal direction of the lock mechanism.

5. The card edge connector as claimed in claim 4, wherein an obtuse angle is formed between the operating portion and the locking portion, said locking portion extends in a transverse direction perpendicular to the longitudinal direction.

6. The card edge connector as claimed in claim 1, wherein each of the tower defines a receiving slot for receiving the lock mechanism and two mutually parallel sidewalls forming on opposite sides of the receiving slot, the lock mechanism is pivot in a receiving slot perpendicular to a longitudinal direction of the insulative housing.

7. The card edge connector as claimed in claim 6, wherein each of the sidewalls defines a hollow depressed from an outer surface to the receiving slot and each of the hollow has a semicircular shape structure on an upper end, each of the sidewalls defines a guide groove depressed from an inner surface to the outer surface and running through a lower end of the guide groove to form a pivoting hole for pivotably receive the lock mechanism.

8. The card edge connector as claimed in claim 1, wherein said locking portion, the operating portion and the body portion has a front surface in a same plane in a longitudinal direction of the lock mechanism.

9. A card edge connector, comprising:

an insulative housing having an central slot extending in a longitudinal direction and a pair of towers positioned at two longitudinal ends thereof;

a plurality of terminals retained in the housing and extending into the central slot; and a pair of lock mechanisms pivoted on the towers in a width direction perpendicular to the longitudinal direction, said lock mechanism has a body portion, an operating portion extending from one side of the body portion in the longitudinal direction, a locking portion extending from one side of the body portion in the width direction and a ejecting portion extending from the body portion in the same side of the locking portion; wherein the card edge connector further defines a handle column retained in an upper surface of the lock mechanism.

10. The card edge connector as claimed in claim 9, wherein the handle column defines a circular shape and has a retaining section and a handle, said handle is located in front of the retaining section and has a larger diameter than the retaining section.

11. The card edge connector as claimed in claim 10, wherein the card edge connector is a slanted type card edge connector, said lock mechanism is pivot in a plane perpendicular to the longitudinal direction of the insulative housing.

12. The card edge connector as claimed in claim 9, wherein each of the towers defines a receiving slot for receiving the lock mechanism and two mutually parallel sidewalls formed on opposite sides of the receiving slot, the lock mechanism is pivot in a receiving slot perpendicular to the longitudinal direction.

13. The card edge connector as claimed in claim 12, wherein each of the sidewalls defines a hollow depressed from the outer surface to the receiving slot and each hollows on a top end has a semicircular shape structure, each of the sidewalls defines a guide groove depressed from the inner surface to the outer surface and running through a top end of the guide groove to formed a pivoting hole for pivotably receiving the lock mechanism.

14. A card edge connector assembly for use with a card edge module, comprising:

an elongated insulative housing defining an elongated slot along a lengthwise direction for receiving the card edge module therein;

a tower located at one end of said housing in said lengthwise direction;

a plurality of terminals disposed in the housing transversely beside the elongated slot with corresponding contacting sections extending into the elongated slot; and an locking mechanism pivotally received in the tower and defining a main body extending along a direction perpendicular to said lengthwise direction and including a locking portion at one end for locking into a notch of the card edge module, an ejecting portion at the other end for kicking off a bottom edge of the card edge module, and a pivotal structure therebetween assembled to the tower wherein said pivotal structure defines a pivotal axis extending along said lengthwise direction so as to allow the locking mechanism to be rotated about a plane perpendicular to said pivotal axis; wherein said locking mechanism further includes an operating portion which extends outwardly from the locking portion in said lengthwise direction for being located outside of a side edge of the card edge module for easy operation under a condition that said operating portion does not extend beyond the locking portion in said direction.

15. The card edge connector as claimed in claim 14, wherein the locking portion and the operating portion are coplanar with each other in said direction.

16. The card edge connector as claimed in claim 15, wherein said tower defines a clipping slot aligned with the elongated slot for receiving a side region of the card edge module.

17. The card edge connector as claimed in claim 14, wherein said depression is formed at the end of the main body adapted to optionally receive a corresponding tool which extends beyond the end of the main body in said direction and may be used to be manually held for operating the locking mechanism instead of the operating portion.

18. The card edge connector as claimed in claim 14, wherein said operating portion outwardly extends beyond the tower in said lengthwise direction.

19. The card edge connector as claimed in claim 14, wherein said locking portion extends in a transverse direction perpendicular to both said lengthwise direction and said direction.

20. The card edge connector as claimed in claim 14, wherein said locking portion defines a wedged structure rather than a rectangular structure for linking to the operating portion.

* * * * *